US007750245B2

(12) United States Patent
Debladis et al.

(10) Patent No.: US 7,750,245 B2
(45) Date of Patent: Jul. 6, 2010

(54) ELECTRIC CONTROL CABLE

(75) Inventors: Francis Debladis, Sainte Catherine les Arras (FR); Stéphane Morice, Leforest (FR); Laurent Tribut, Lyons (FR)

(73) Assignee: Nexans, Paris (FR)

( * ) Notice: Subject to any disclaimer, the term of this patent is extended or adjusted under 35 U.S.C. 154(b) by 87 days.

(21) Appl. No.: 12/148,525

(22) Filed: Apr. 18, 2008

(65) Prior Publication Data

US 2008/0296043 A1 Dec. 4, 2008

(30) Foreign Application Priority Data

Apr. 27, 2007 (FR) ..... 07 54760

(51) Int. Cl.
*H01B 7/00* (2006.01)

(52) U.S. Cl. ..... 174/113 R; 174/113 C

(58) Field of Classification Search ..... 174/102 R, 174/108, 106 R, 110 R, 113 R, 113 C, 128.1, 174/128.2

See application file for complete search history.

(56) References Cited

U.S. PATENT DOCUMENTS

| | | | | |
|---|---|---|---|---|
| 3,322,889 | A | 5/1967 | Bird et al. | 174/131 A |
| 4,034,547 | A * | 7/1977 | Loos | 57/211 |
| 4,097,686 | A | 6/1978 | Gladenbeck et al. | 174/113 R |
| 4,861,947 | A * | 8/1989 | Altermatt et al. | 174/113 C |
| 5,269,128 | A * | 12/1993 | Walton et al. | 57/210 |
| 5,797,254 | A * | 8/1998 | Walton | 57/220 |
| 7,145,082 | B2 * | 12/2006 | Hochleithner et al. | 174/113 C |
| 2005/0183808 | A1 * | 8/2005 | Barguet et al. | 152/527 |

FOREIGN PATENT DOCUMENTS

| | | |
|---|---|---|
| DE | 4136227 | 5/1993 |
| GB | 1153070 | 5/1969 |

* cited by examiner

*Primary Examiner*—William H Mayo, III
(74) *Attorney, Agent, or Firm*—Sofer & Haroun, LLP

(57) ABSTRACT

A composite control cable has a polymer core and a plurality of strands of electrically conductive material extending in the longitudinal direction of the cable around said core. The polymer is selected from polymers presenting elongation at break that is greater than 7%, and traction strength such that the resultant traction strength of the cable is greater than a predetermined limit value.

6 Claims, 1 Drawing Sheet

ELECTRIC CONTROL CABLE

RELATED APPLICATION

This application claims the benefit of priority from French Patent Application No. 07 54760, filed on Apr. 27, 2007, the entirety of which is incorporated herein by reference.

BACKGROUND

1. Field of the Invention

The present invention relates to electric control cables, or power cables, used for conveying currents.

2. Description of Related Art

Such cables are used in various fields in industry, such as for example the automotive industry, where they are assembled into bundles for feeding electricity to various pieces of equipment. It is therefore necessary, in particular, for such cables to be as light in weight as possible, and to be compact, while nevertheless conserving good mechanical strength.

Such cables are conventionally made up of a plurality of strands of copper, generally twisted to form a twisted strand so as to increase the flexibility of the cable, and surround by an insulating sheath, e.g. obtained by extrusion.

Figure 1:
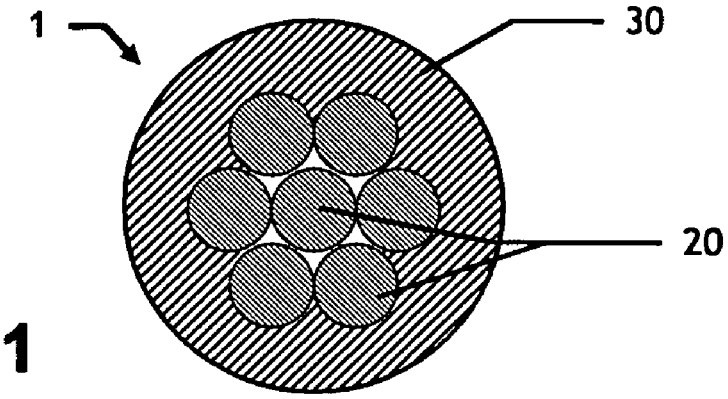
FIG. 1 PRIOR ART
FIG. 1 shows an example of such a cable 1, seen in cross-section, and made from seven identical copper strands 20 surrounded by an insulating sheath 30 of circular section. To give an idea of size, the diameter of the cable is typically about 1.6 millimeters (mm) and each copper strand 20 presents a diameter of about 0.3 mm.

Other cables of structure similar to that of FIG. 1, but having some other number of copper strands, e.g. nineteen strands, are also known.

Figure 2:
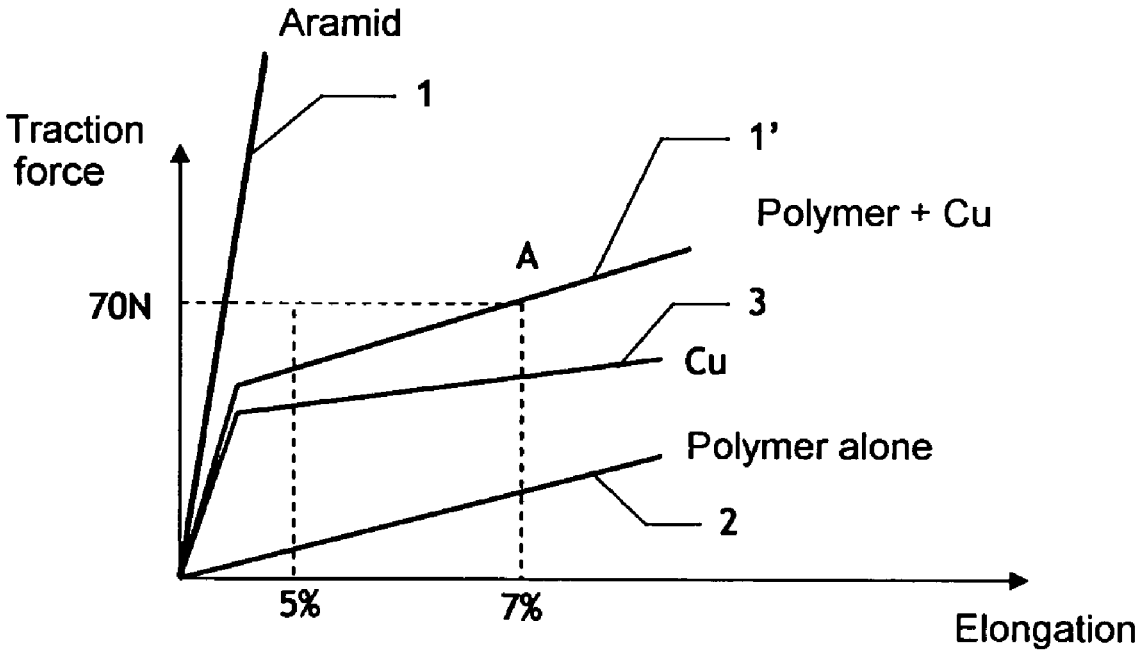

FIG. 2 illustrates a traction curve plotting traction force versus elongation for a plurality of cables of different construction.

The advantages of a cable with the above structure lie essentially in the simplicity of the fabrication method, and also in the fact that it can be crimped reliably to connectors. It suffices to strip the cable locally by removing a portion of the insulating sheath 30 where it is desired to place the connector, and then to mechanically compress a connector bushing around the stripped section of cable. In addition, copper intrinsically presents good mechanical traction strength.

In contrast, it has been found that the above cable makes use of a quantity of copper that is excessive compared with the real requirements corresponding to the quantity of electric current that is to be transmitted by the cable. More precisely, about half of the copper in the above cable structure is used for increasing the traction strength of the cable, and also for guaranteeing effective crimping.

Unfortunately, copper is becoming ever more expensive, and it is important to find new cable structures that reduce the quantity of copper used to as little as possible.

Various solutions are already known for composite cables in which copper strands are combined with a core of non-conductive material. In particular, U.S. Pat. No. 7,145,082 describes a control cable in which a plurality of conductor wires, e.g. copper wires, are twisted around a central core made up of a multifilament polymer of the aramid fiber type.

That type of cable makes it possible to reduce the quantity of copper used significantly, down to the value actually required for proper transmission of the signal, while conserving very good traction strength because of the use of aramid.

In contrast, although aramid possesses very high traction strength compatible with the values required, that type of material presents little elongation at break, typically of the order of only 3%. Those characteristics are shown by traction curve 1 in FIG. 2 plotting the traction force required as a function of elongation for aramid.

Throughout the utilization of lifetime of a cable, and in particular at the time it is being installed, e.g. inside a motor vehicle, or in the event of subsequent action on the cable for replacement or repair purposes, it can become necessary, or inevitable, that traction is applied on the cable in order to lengthen it. This applies in particular when it is desired to connect the end of the cable to a connection box that is situated in a location that it is difficult to access within the motor vehicle. If a cable having an aramid fiber core is pulled, whether intentionally or not, it does not lengthen.

OBJECTS AND SUMMARY

To solve that problem, the present invention provides a composite control cable comprising a polymer core and a plurality of strands of electrically conductive material extending in the longitudinal direction of the cable around said core, wherein the polymer is selected from polymers presenting elongation at break that is greater than 7%, and traction strength such that the resultant traction strength of the cable is greater than a predetermined limit value.

DETAILED DESCRIPTION

The traction curve for an example of such a polymer is shown diagrammatically under reference 2 in FIG. 2. It can be seen that the traction force of the selected polymer varies linearly as a function of the amount of elongation, preferably with a slope that is small. As a result, it is easy to obtain elongation of the cable by exerting a minimum traction force.

The traction curve 1' of the cable is the result of the traction curve 2 for the core made of polymer only, and of the traction curve 3 for the strands of electrically conductive material, i.e. copper in this example. Point A on curve 1' represents the minimum traction strength required for the cable in order to obtain the desired minimum elongation of break at 7%. Tests have shown that by using a polymer selected in accordance with the invention, such as a polyethylene naphthalate (PEN), or a polyester (PES), or a polyethylene terephthalate (PET), it is possible to obtain traction strengths that are greater than a limit value of about 70 newtons (N), thus corresponding to the requirements that generally apply in the field of the automotive industry, by using polymers that present traction strength that is much less than that of aramid.

By way of non-limiting example, the polymer core preferably presents a diameter lying in the range 0.2 mm to 0.3 mm. The number of copper strands used, e.g. twisted, around the core is preferably selected to surround the entire circumference of the core in continuous manner. Under such circumstances, the copper strands are then always in contact in pairs over the entire length of the cable, thereby increasing the reliability with which connectors are crimped onto the ends of the cable. Thus, if the diameter of the polymer core is 0.3 mm, it is advantageous to use nine copper strands each having a diameter of 0.16 mm. If the diameter of the core is 0.2 mm, it is advantageous to use six copper strands each having a diameter of 0.2 mm. In both configurations, a cable is obtained in which the quantity of copper is considerably smaller than that in the above-described seven-strand cable, while presenting mechanical performance and compactness that are similar.

Although the present invention is described in the context of a cable making use of strands of copper, the invention can be applied regardless of the particular electrical conductor material used for the strands that surround the polyamide core (copper alloy, aluminum, or aluminum alloy, amongst others).

What is claimed is:

1. A composite electric control cable comprising:

a polymer core and a plurality of strands of electrically conductive material extending in the longitudinal direction of the cable around said core, wherein the polymer is selected from polymers presenting elongation at break that is greater than 7%, and traction strength such that the resultant traction strength of the cable is greater than a predetermined limit value.

2. A control cable according to claim 1, wherein said strands are twisted around the core.

3. A control cable according to claim 1, wherein said strands are made of copper.

4. A control cable according to claim 1, wherein the polymer is polyethylene naphthalate.

5. A control cable according to claim 1, wherein the polymer is polyester.

6. A control cable according to claim 1, wherein the polymer is polyethylene terephthalate.

* * * * *